US005822928A

United States Patent [19]

Maxwell et al.

[11] Patent Number: 5,822,928

[45] Date of Patent: Oct. 20, 1998

[54] MOTION PICTURE THEATRE STRUCTURE

[75] Inventors: Ian Maxwell, Oakville; G. Eric Jacques, Burlington; Ilidio Paulo Coito, Mississauga, all of Canada

[73] Assignee: Imax Corporation, Mississauga, Canada

[21] Appl. No.: 807,922

[22] Filed: Feb. 28, 1997

[51] Int. Cl.[6] ..... E04H 3/12

[52] U.S. Cl. ..... 52/8; 52/6

[58] Field of Search ..... 52/6, 8

[56] References Cited

U.S. PATENT DOCUMENTS 1,957,947 5/1934 Dreyfuss ..... 52/6

5,469,669 11/1995 Alter ..... 52/8

*Primary Examiner*—Creighton Smith

*Attorney, Agent, or Firm*—Bereskin & Parr

[57] ABSTRACT

A theatre designed to provide an intimate environment for an audience, particularly for watching 3-D motion pictures. The theatre has an auditorium with a sloped seating deck and audience entry/exit points on opposite sides, generally at an intermediate level of the deck. The entry/exit points are generally at ground level with the portion of the deck below those points in an excavated pit. A ground level lobby connects to the access points by aisles outwardly of opposite sides of the auditorium and a projection room is provided above the lobby.

4 Claims, 4 Drawing Sheets

MOTION PICTURE THEATRE STRUCTURE

FIELD OF THE INVENTION

This invention relates generally to motion picture theatres, particularly theatres designed for showing on giant screens, large format films such as those that are available from Imax Corporation.

BACKGROUND OF THE INVENTION

Recent trends in the design of the theatres for showing large format films have emphasized creation of an intimate environment intended to give audience members a feeling of participation in the events depicted by the projected images. Proposals have been made for theatre auditoriums which have relatively low overall volume and small numbers of seats, but which are furnished to high standards. Great attention is paid to the projection of large, high quality images that fill the field of view of the audience. 3-D image projection, and CD quality sound systems also are features of "intimate" theatre design.

Of course, cost is also a consideration. Attention must be paid to the design of the theatre in terms of its suitability for construction using normal construction techniques and without requiring, for example, excessive ground excavation or other special features. Ideally, it should be possible to incorporate the theatre in an existing "multiplex" theatre, or other facility, or to add the theatre onto an existing such facility.

U.S. Pat. No. 5,469,669 (Alter) discloses a theatre construction which is intended to be simpler in design and of reduced cost as compared with existing IMAX (TM) theatre designs. The Alter design features a ground level lobby with a seating region which is angled downwardly from the lobby into a pit towards the projection screen. Audience members entering through the lobby must walk down the inclined seating region to enter the theatre and then must walk back up to the lobby to exit. A projector is provided in the lobby and includes an elevator for raising the projector from a ground level position for maintenance and set up, to an elevated position for projecting into the auditorium through a window above the seats. While a theatre design of the form proposed by Alter may offer some advantages, a disadvantage is the need to excavate a relatively deep pit to accommodate the seats, and the need to provide an elevator for the projector.

The Alter patent discloses a prior IMAX (TM) theatre design which does not require a deep pit. However, that design does require several different levels in the lobby area of the theatre. Patrons enter the theatre at the bottom of a sloping array of seats and climb stairs to reach their seats. When the show is over, the patrons climb further to an upper level where they are required to descend stairs to exit the theatre. While a design in which patrons are always going up rather than down through the seating area is believed to be a safer design in terms of the risk of audience injury, a penalty is paid in terms of the complexity of the lobby area of the theatre.

An object of the present invention is to provide a theatre structure which offers a number of improvements as compared with the prior art, particularly where the objective is to create an "intimate" theatre environment.

SUMMARY OF THE INVENTION

According to the invention there is provided a motion picture theatre structure which includes an auditorium having first and second opposite ends, a projection screen at said first end, and a seating deck which includes an array of seats arranged in rows that extend generally transversely with respect to the screen. The seating deck slopes downwardly in a direction from the second end of the auditorium towards the screen. Entry/exit points for audience members are provided, one at each side of the seating deck, and each located generally at an intermediate level between upper and lower ends of the deck so that multiple rows of seat exist both above and below the entry/exit points. The seating deck provides access to the seats from both of the entry/exit points at respective ends of each row of seats. The structure further includes a projection room at the second end of the auditorium for projecting images onto the screen.

The provision of intermediate seating level entry/exit points offers a number of advantages. One is that this arrangement is believed to represent the optimum for "loading" and "unloading" the theatre. There may be roughly equal numbers of seats above and below the entry/exit points so that patrons will enter the auditorium from those points with some people going up and some going down, minimizing congestion. The entry/exit points may be arranged approximately at ground level, which avoids the need for a second floor in the theatre structure and the need for a special purpose elevator for handicap access. A pit then is required for the portion of the seating deck below the entry/exit points, but it can be of relatively low depth, and certainly less than half of the depth required in a comparable theatre having ground level access points at the top of the seating deck. With the theatre provided by the invention, a maximum ten foot pit excavation probably will be required during construction, which is within standard building practice and therefore lower in cost than a deeper pit.

Preferably, the entry/exit points are provided at ends of respective access aisles at opposite sides of the auditorium and the aisles connect to a common lobby outwardly of the second end of the auditorium. The lobby can be at ground level and the access aisles can be ground level passageways or slightly inclined ramps which makes for ease of access to the seating deck, even for patrons who require the use of wheelchairs. Handicap seating can be provided in a row of seats which is immediately adjacent to and extends between the entry/exit points at opposite sides of the auditorium.

The projection room can be a permanent part of the theatre structure that is immediately above the lobby of the theatre. There is then no need for a projector elevator. Typically, the screen will extend substantially to the bottom of the pit in which the lower part of the seating deck in accommodated. The combination of this screening location and the ground level lobby for audience entry/exit allows the projector to be lower relative to the screen centre line than would normally be the case. This in turn provides for a better overall image because of less "keystoning" due to the location of the projection point with respect to the screen in the vertical direction.

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
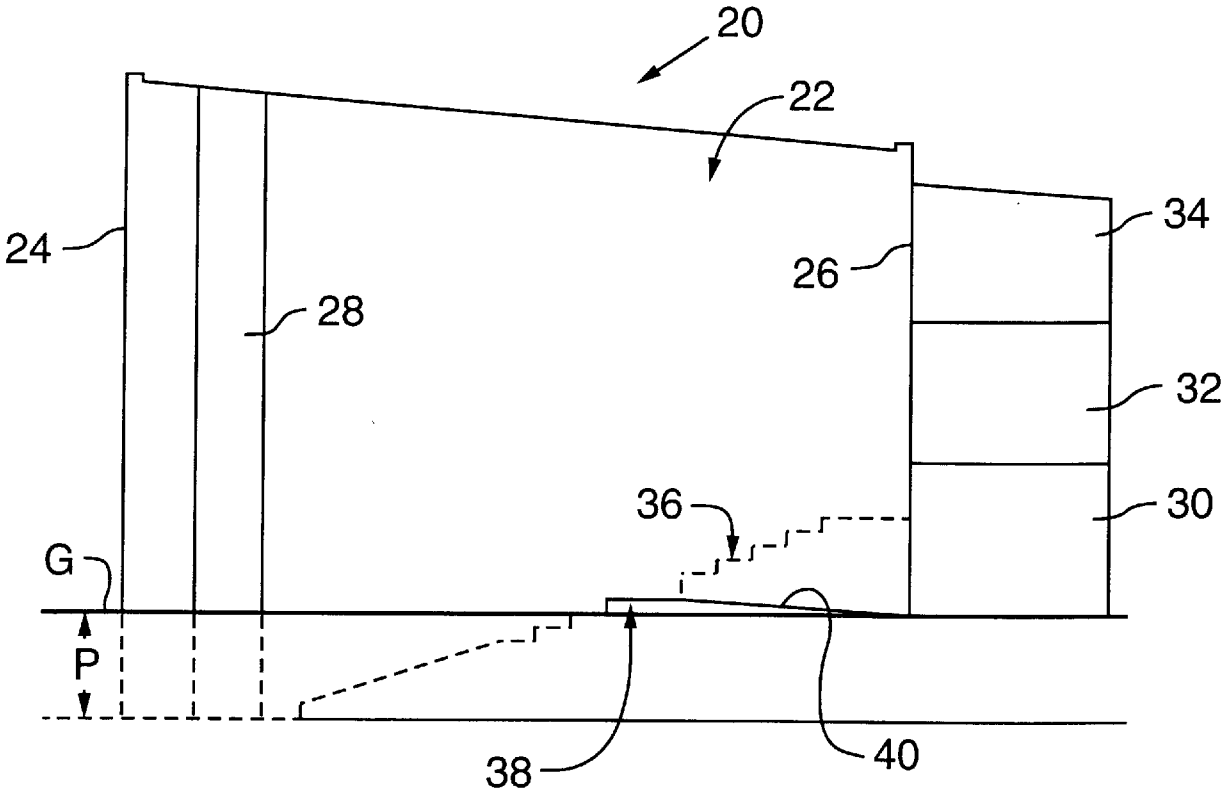
FIG. 1 is a schematic side elevational view of a theatre structure in accordance with the invention.
Figure 3:
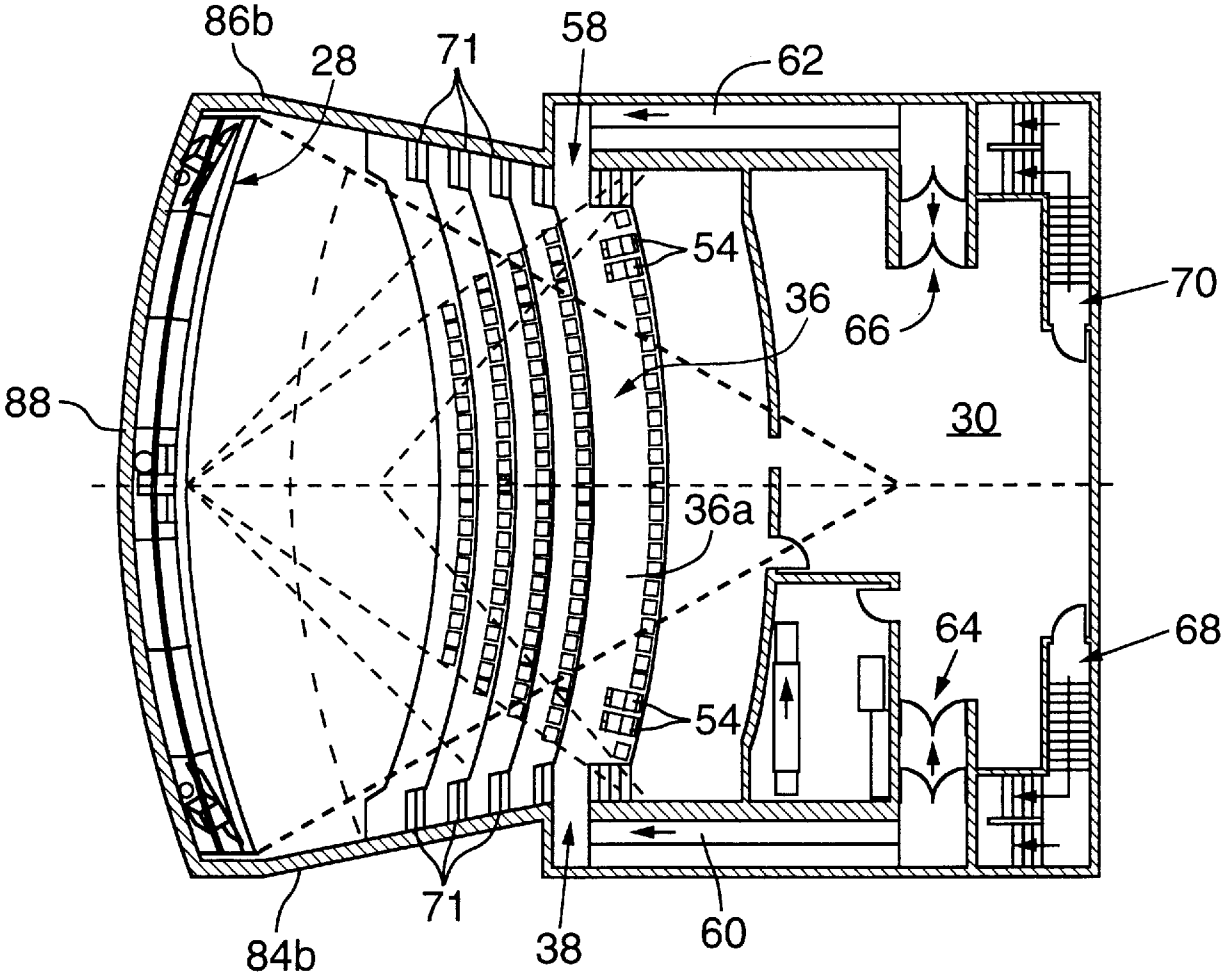
FIG. 3 is a plan view at the entry level of the theatre structure shown in FIG. 1, and is taken generally on the line denoted II—II.
Figure 4:
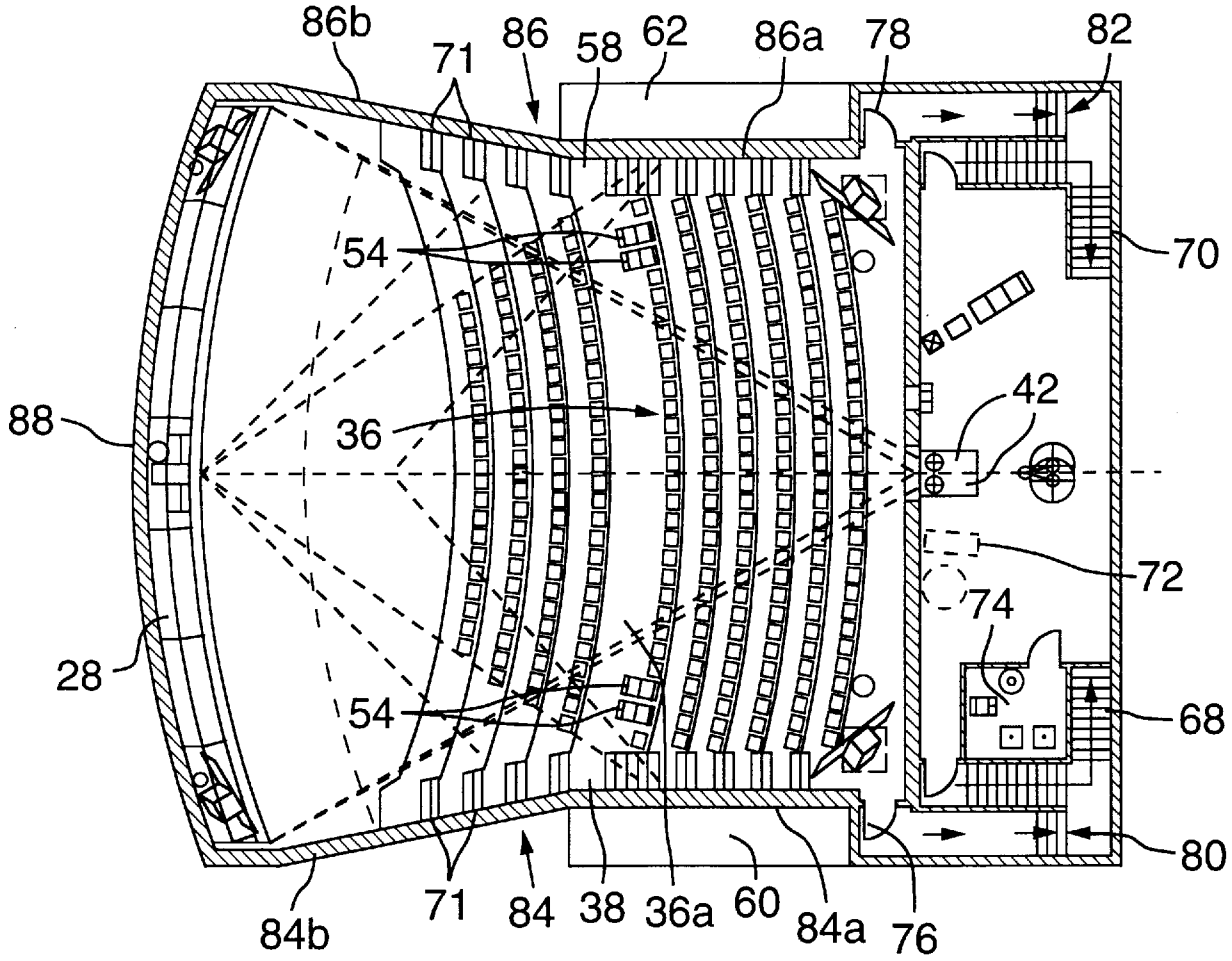
FIG. 4 is a view similar to FIG. 3 but taken at the projection level, generally on line III—III of FIG. 2.

Referring first to FIG. 1, a motion picture theatre structure is generally denoted by reference numeral 20 and includes an auditorium 22 having first and second opposite ends 24 and 26 respectively. A projection screen at the first end 24 is represented at 28 and has a shape which is curved in plan, as best seen in FIGS. 3 and 4. A lobby for the theatre is indicated at 30 and a projection room above the lobby at 32. An optional mechanical room 34 is provided above the projection room 32.

Figure 2:
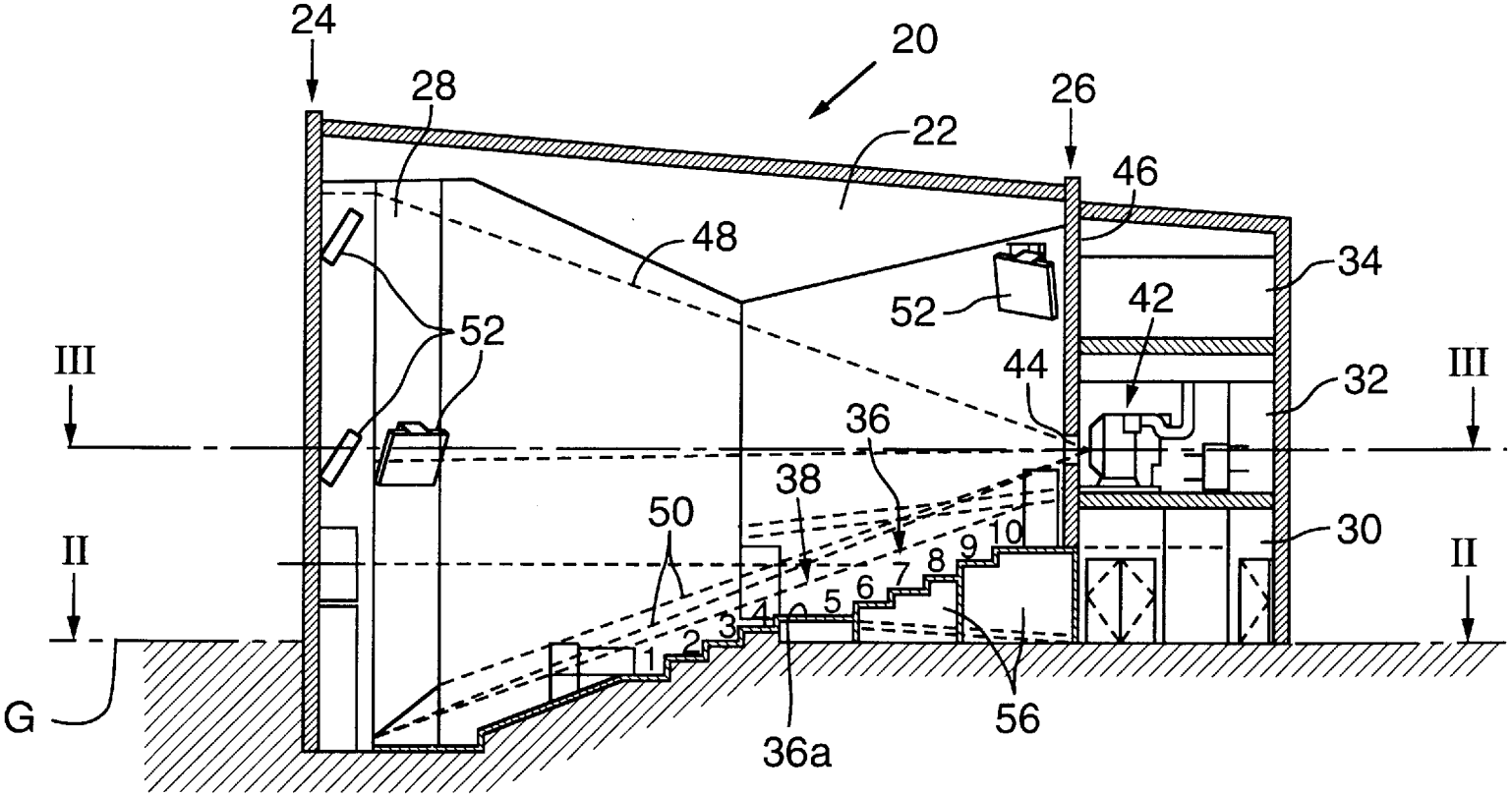
FIG. 2 is an elongitudinal section view corresponding to FIG. 1.

Ground level is indicated at G in each of FIGS. 1 and 2. A stepped seating deck within the auditorium is shown at 36 and one of two entry/exit points for audience members is indicated at 38. 40 indicates an aisle to access point 38 from lobby 30. It will be seen from FIG. 1 that there is a slight incline from ground level lobby 30 to the access point 38. This is done to allow roughly even distribution of seats above and below the access points, while at the same time allowing ease of access for patrons, even those using wheelchairs.

A portion of the seating deck 36 below the entry/exit points (38) is accommodated in a pit that is excavated below ground level during construction of the theatre. The height of the pit is denoted P is FIG. 1 and typically is a maximum of 10 feet.

FIG. 2 is a view similar to FIG. 1 but showing some internal details of the theatre. A 3-D projector installation in the projection room 32 is generally shown at 42 and projects through an opening 44 in a rear wall 46 at the second end of the auditorium 22. The vertical extent of the images projected from projector 42 are represented by the lines denoted 48 and 50. Though not part of the invention, various speakers used in the sound system of the theatre are shown at 52.

Seating deck 36 includes ten rows of seats which are denoted by numbers 1–10. The entry/exit point 38 (and a corresponding point at the opposite side of the auditorium) are located at opposite ends of a walkway 36*a* between rows 4 and 5; it will be seen that the width of the walkway is somewhat greater than the spacings between the other rows of seats to allow wheelchair access. Walkway 36*a* is also shown in FIGS. 3 and 4 where a number of wheelchairs have been shown at 54.

Reverting to FIG. 2, it will be seen that the lower half of the seating deck 36 represented by rows 1, 2, 3 and 4 lies on the sloping excavated floor of the pit referred to previously. The higher rows of seats are supported by a appropriate structure above the "base" ground level and may be designed to provide rooms 56, for example storage or other purposes, such as a cleaning room for 3-D glasses.

FIGS. 3 and 4 show the theatre structure as seen in plan respectively on lines II—Il and III—III of FIG. 2. As in the previous views, one of the two audience access points is denoted 38, while a corresponding access point at the opposite side of the auditorium is indicated at 58. Aisles 60 and 62 provide communication between the respective access points and the lobby 30. Doors giving access to the respective aisles are indicated in FIG. 3 at 64 and 66 respectively. Stairs providing access to the projection room above the lobby are shown at 68 and 70.

Steps 71 on both sides of the auditorium allow patrons to walk up or down the seating deck to and from entry/exit points 38 and 58.

FIG. 4 is a view similar to FIG. 3 but taken at the level of the projection window 44 (FIG. 2). It will be seen that there are in fact two projectors 42 which are disposed side by side for projecting stereoscopic images. Space for a standard projector is provided as indicated at 72 in FIG. 4 so that the theatre can be converted for non 3-D use. Auxiliary equipment such as reel units and storage cabinets have been indicated in FIG. 4 but will not be described specifically. An auxiliary equipment room is shown at 74 within the projection room.

FIG. 4 also shows emergency exits 76 and 78 which communicate with respective stairways 80 and 82 down to the lobby 30.

FIGS. 3 and 4 show that the auditorium itself has a novel overall shape as seen in the plan. Respective side walls of the auditorium are denoted 84 and 86 and an outer (screen) end wall is indicated at 88. It will be seen that the side walls 84 and 86 include respective wall portions 84*a* and 86*a* inwardly of the two aisles 60 and 62 which extend parallel to one another up to the entry/exit points 38 and 58. The walls then diverge (portions 84*b* and 86*b*) to the end wall 88. This wall has a minimal lateral dimension sufficient to accommodate the screen 28, and is curved to match the curvature of the screen. By sloping the side walls of the auditorium (84*b* and 86*b*), the volume of the space within the auditorium is reduced as far as is practicable, which is believed to be an important feature in achieving intimate ambience for the audience as well as minimizing operating costs such as heating and air-conditioning and providing improved acoustical performance.

In summary, the features that have been described are believed to result in a theatre which can be constructed at relatively low cost (compatible with a high quality environment) by conventional construction techniques. At the same time, a small, intimate audience environment is provided, typically accommodating about 270 audience members. Safe access to and egress from the seating area is provided for all audience members, including those who are physically challenged.

It should of course be understood that the preceding description relates to a particular preferred embodiment of the invention and that modifications are possible. For example, the feature of mid-level seating access could be used (at extra cost) in a theatre that is not built with a ground level lobby. Also, the features of the invention could be used in conventional theatres, i.e. theatres not specifically designed for showing large format films.

We claim:

1. A motion picture theatre structure comprising:

an auditorium having first and second opposite ends;

a projection screen at said first end of the auditorium and a lobby at said second end of the auditorium, the lobby having a floor at a defined level;

a seating deck which includes an array of seats arranged in rows generally transversely with respect to said screen, said seating deck sloping downwardly in a direction from said second end of the auditorium towards said screen;

entry/exit points for audience members, one at each side of said seating deck, each said entry/exit point being located generally at said defined level and generally intermediate upper and lower ends of the deck so that multiple rows of seats exist both above and below the entry/exit points, the seating deck providing access to said seats for audience members from both of said entry/exit points at respective ends of each row of seats;

respective access aisles at opposite sides of the auditorium connecting the lobby with the respective entry/exit points; and, a projection room at said second end of the auditorium above the lobby, for projecting images onto said screen.

2. A theatre structure as claimed in claim 7, wherein said defined level is ground level, whereby said lobby, aisles and entry/exit points are generally at ground level, and wherein the portion of the seating deck below said entry/exit points is located in an excavated pit below ground level.

3. A theatre structure as claimed in claim 1, wherein said auditorium has a shape as seen in plan defined by side walls inwardly of said aisles which extend parallel to one another to said entry/exit points and which then diverge to an end wall at said first end of the auditorium having a minimum lateral dimension sufficient to accommodate said screen.

4. A theatre structure as claimed in claim 5, wherein said screen is curved as seen in plan and said end wall of the auditorium is curved to follow said screen curvature.

* * * * *